US006561272B2

(12) United States Patent
Buzinsky et al.

(10) Patent No.: US 6,561,272 B2
(45) Date of Patent: May 13, 2003

(54) TECHNIQUE FOR DEPLOYING A LINER INTO A SUBTERRANEAN WELLBORE

(75) Inventors: Andrew Buzinsky, Sherwood Park (CA); Jozeph Robert Marcin, St. Albert (CA)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 09/877,564

(22) Filed: Jun. 8, 2001

(65) Prior Publication Data

US 2002/0185281 A1 Dec. 12, 2002

(51) Int. Cl.[7] ..... E21B 33/13

(52) U.S. Cl. ..... 166/291; 166/212; 166/383; 166/386; 166/332.4; 166/332.5

(58) Field of Search ..... 166/212, 291, 166/332.4, 332.5, 380, 383, 386, 319

(56) References Cited

U.S. PATENT DOCUMENTS

| | | | | |
|---|---|---|---|---|
| 2,508,285 | A | | 5/1950 | Otis et al. |
| 2,885,011 | A | | 5/1959 | Frost |
| 2,887,163 | A | | 5/1959 | McGowen, Jr. et al. |
| 3,203,483 | A | * | 8/1965 | Vincent |
| 3,358,760 | A | * | 12/1967 | Blagg |
| 3,498,376 | A | * | 3/1970 | Sizer et al. |
| 3,548,936 | A | | 12/1970 | Kilgore et al. |
| 3,581,817 | A | | 6/1971 | Kammerer, Jr. |
| 3,669,190 | A | * | 6/1972 | Sizer et al. |
| 5,551,512 | A | | 9/1996 | Smith |
| 5,722,491 | A | * | 3/1998 | Sullaway et al. |
| 6,050,341 | A | | 4/2000 | Metcalf |

* cited by examiner

*Primary Examiner*—Roger Schoeppel
(74) *Attorney, Agent, or Firm*—Fletcher, Yoder & Van Someren; Jeffrey E. Griffin; Brigitte L. Jeffrey

(57) ABSTRACT

A technique for deploying a liner within a wellbore. The technique utilizes a flush bore running tool that may be coupled to the interior of the liner during deployment of the liner. The mechanism for coupling the running tool and the liner permits the use of the full diameter of the liner after the running tool is released and removed from the liner.

30 Claims, 3 Drawing Sheets

TECHNIQUE FOR DEPLOYING A LINER INTO A SUBTERRANEAN WELLBORE

FIELD OF THE INVENTION

The present invention relates generally to the deployment of liners within wellbores, and particularly to the deployment of flush bore liners.

BACKGROUND OF THE INVENTION

In a variety of applications, wellbores are lined with a liner, e.g. a liner pipe. Exemplary applications comprise oil and gas wells accessed by wellbores drilled into subterranean formations.

In some of these applications, particularly when the wellbore is a lateral wellbore, frictional drag is created between the bore hole and the liner creating difficulty in moving the liner into proximity with the bottom of the wellbore. The friction acts against the outside surface of the liner and tends to buckle or "corkscrew" the liner. The buckled or corkscrewed liner often forms a long, helical shape in the wellbore that forces the liner against the wellbore walls to create even greater frictional forces. This problem is particularly pronounced with conventional systems where force is applied to the liner at the very top to push the liner into the hole while the frictional resistance begins from the bottom of the liner.

Attempts have been made to reduce these frictional forces by pulling the liner from a lower or bottom region rather than pushing from the top. However, tools used to pull the liner are designed to engage features that extend inwardly from the liner, such as a setting sleeve having internal steel threads protruding into the bore of the liner to engage the running tool. However, once the liner is deployed and cemented in place, the inwardly extending features remain and cannot be drilled with a conventional rock bit. Accordingly, if the full inside diameter of the liner is needed or desired, the inwardly extending features, e.g. threads, must be removed by special milling tools. This, of course, incurs additional costs to the well operator due to the extra tools required and the lost production time during milling of the threads.

SUMMARY OF THE INVENTION

The present invention relates generally to a technique for lining a wellbore, such as a lateral wellbore. The technique allows the use of a flush bore liner that may be deployed in a wellbore by pulling the liner from a lower region. The technique utilizes a running tool that may be selectively coupled to the liner without utilizing features that cannot be removed from the liner with a conventional rock bit.

BRIEF DESCRIPTION OF THE DRAWINGS

The invention will hereafter be described with reference to the accompanying drawings, wherein like reference numerals denote like elements, and.

DETAILED DESCRIPTION OF THE EXEMPLARY EMBODIMENTS

Figure 1:
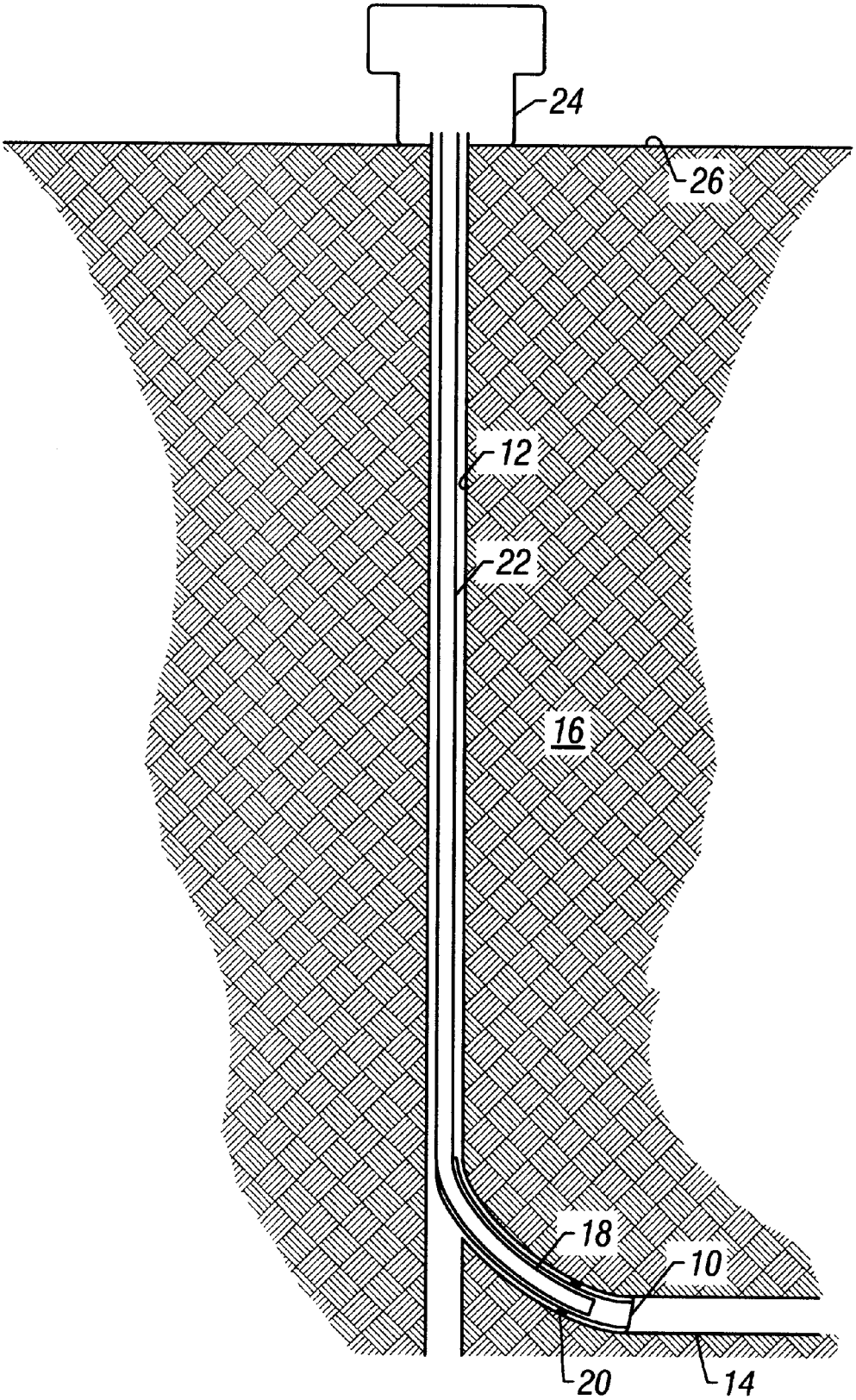
FIG. 1 is a schematic view of a liner being deployed in a lateral wellbore according to one embodiment of the present technique.

Referring generally to FIG. 1, an exemplary liner deployment application is illustrated. In this embodiment, a liner 10, such as a liner pipe, is deployed through a wellbore 12 into a lateral wellbore 14. Wellbore 12 and lateral wellbore 14 are formed within a geological formation 16 that typically contains desirable production fluids, such as petroleum.

Liner 10 is coupled to a running tool 18 by a connection assembly 20. The exemplary running tool 18 is a flush bore running tool (as will be explained more fully below) coupled to appropriate deployment tubing 22. Deployment tubing 22 is suspended from an assembly 24, such as a tubing hanger. Furthermore, wellbore 12 typically extends from an upper surface 26, such as a land surface or subsea surface.

Figure 2A:
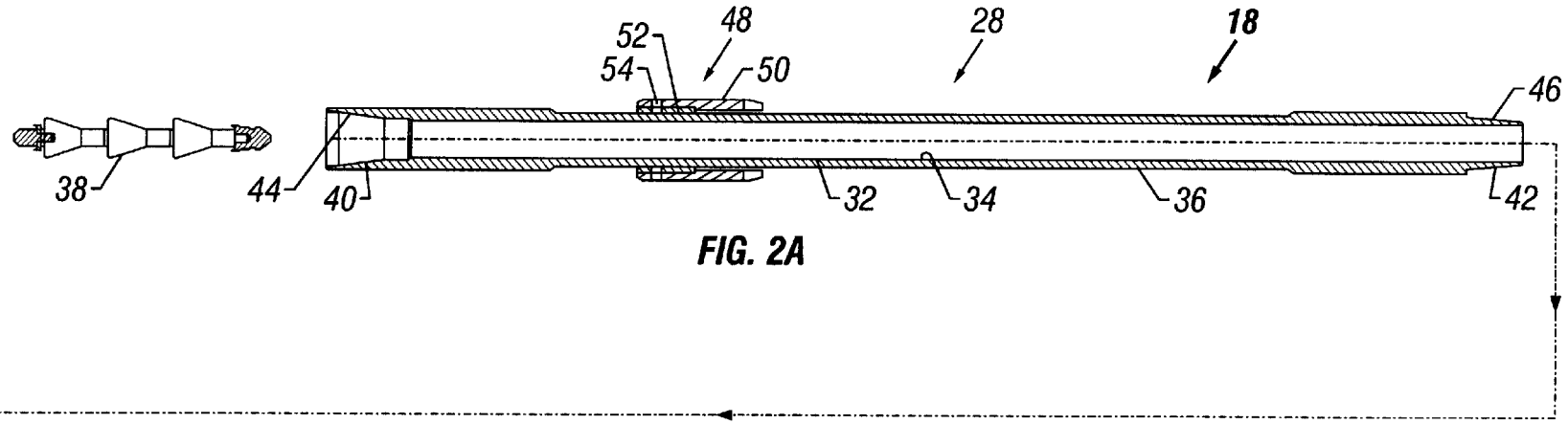
FIG. 2A is a cross-sectional view taken generally along the axis of an upper portion of a flush bore running tool, according to one embodiment of the present invention.
Figure 2B:
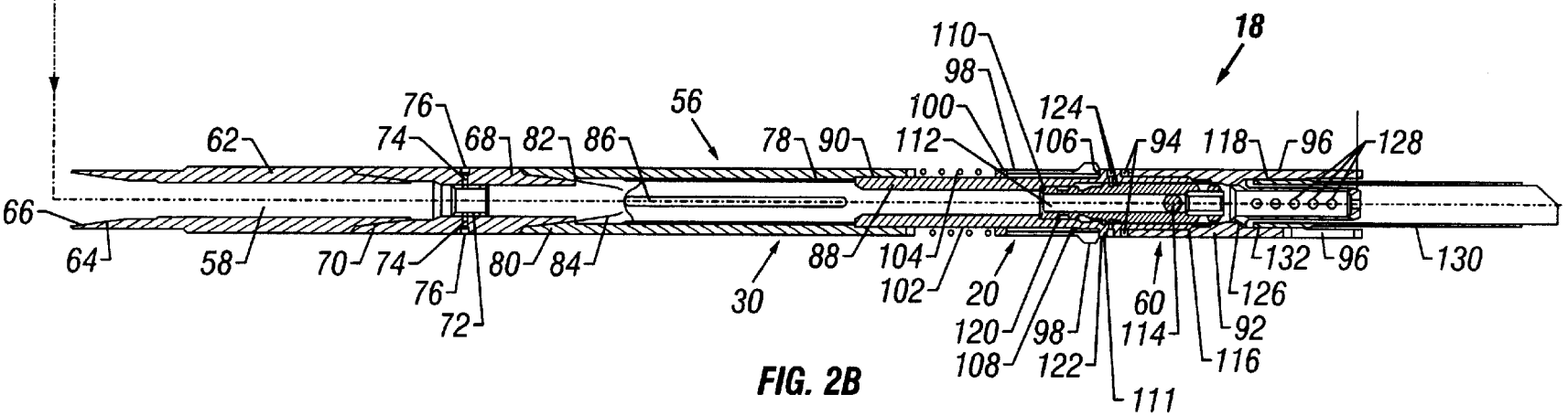
FIG. 2B is a cross-sectional view taken generally along the axis of the lower portion of the flush bore running tool referenced in FIG. 2A.

Referring generally to FIGS. 2A and 2B, one exemplary running tool 18 is illustrated. An upper portion 28 of running tool 18 is illustrated in FIG. 2A and a lower portion 30 of running tool 18 is illustrated in FIG. 2B.

Upper portion 28 comprises a tubing section 32 having a hollow interior 34 and an outer surface 36. Hollow interior 34 is sized to receive a dart assembly 38 therethrough. Upper portion 28 further comprises an upper attachment region 40 and a lower attachment region 42. Upper attachment region 40 is designed to couple running tool 18 to deployment tubing 22 by, for example, threaded engagement via a threaded region 44. Lower attachment region 42 is designed for coupling upper portion 28 with lower portion 30 by, for example, threaded engagement via a threaded region 46.

Upper portion 28 also may include a closure member 48 positioned and designed to fit over the top of liner 10 to limit the amount of debris that otherwise could fall into liner 10 during deployment. An exemplary closure member 48 comprises a junk bushing 50 positioned around an insert 52. Junk bushing 50 and insert 52 may be positioned along the outer surface 36 of tubing section 32 by one or more set screws 54.

Referring generally to FIG. 2B, lower portion 30 generally comprises an outer structural housing 56 having a flow path 58 therethrough. Flow path 58 cooperates with hollow interior 34 to provide a fluid flow path through the entire running tool 18. Lower portion 30 also generally comprises connection assembly 20 and a release mechanism 60 that permits selective release of running tool 18 from liner 10. It should be noted that a variety of components and configurations can be utilized in forming outer structural housing 56, connection assembly 20 and release mechanism 60. The actual design may vary according to the desired application, environment, structural integrity required, etc. without departing from the scope of the present invention.

In the illustrated embodiment, outer structural housing 56 comprises a crossover sub 62 having an upper attachment end 64 designed to engage lower attachment region 42 of upper portion 28. Upper attachment end 64 may include, for example, a threaded region 66 designed for engagement with threaded region 46, as known to those of ordinary skill in the art.

Crossover sub 62 is coupled to a dart seat sub 68 by, for example, threaded engagement at a threaded region 70. Dart seat sub 68 may include a dart seat 72 held within flow path 58 by one or more shear screws 74 that secure dart seat 72 in place until struck by dart assembly 38. Additionally, a pipe plug 76 is positioned radially outward of each shear screw 74 to prevent leakage of fluid from flow path 58 after shearing of shear screw 74. Typically, screws 74 are sheared during cementation of liner 10 when dart assembly 38 is utilized to force cement material along flow path 58.

At a lower end, dart seat sub 68 is coupled to a dart by-pass sub 78 by, for example, a threaded region 80. Dart by-pass sub 78 comprises a one-way dart by-pass 82 having a flexible retainer portion 84 designed to hold dart assembly 38 within the flow path 58. Additionally, dart by-pass sub 78 may include one or more inserts 86 that permit a restricted flow of fluid past dart assembly 38 when retained by dart by-pass sub 78. This permits, for example, the draining of deployment tubing 22 and running tool 18 when running tool 18 is retrieved from liner 10 and moved upwardly to upper surface 26.

In the illustrated embodiment, dart by-pass sub 78 also is coupled to a lock sub 88 via, for example, a threaded region 90. Lock sub 88 is designed for cooperation with connection assembly 20. Additionally, lock sub 88 is coupled to a lower sub 92 by, for example, a plurality of shear screws 94. The lower sub 92 may comprise a plurality of lead fingers 96 designed to engage corresponding features of liner 10 (see FIG. 3C where lead fingers 96 are approaching engagement with liner 10).

Figure 3A:
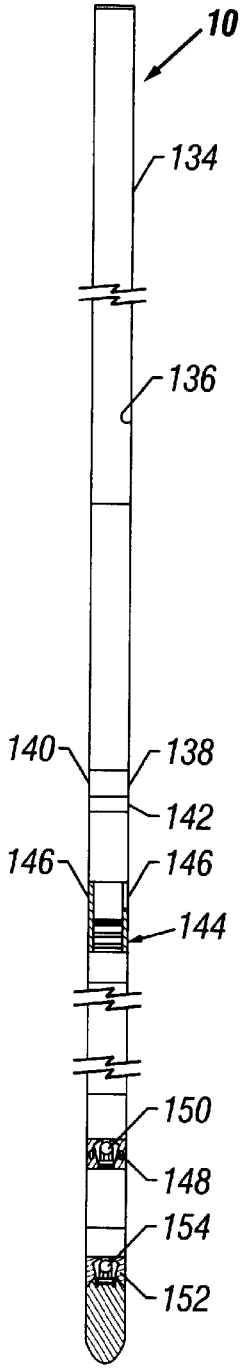
FIG. 3A is a cross-sectional view of an exemplary liner that may be coupled to the flush bore running tool illustrated in FIGS. 2A and 2B.

An exemplary connection assembly 20 comprises a plurality of radially expandable fingers 98 that may be held in a radially outward position to engage corresponding features of liner 10 (see FIG. 3A). In this embodiment, fingers 98 form part of an overall collet 100 slidably received along an external surface 102 of lock sub 88. A spring member 104, such as a coil spring, biases collet 100 axially towards an abutment 106 such that fingers 98 abut against abutment 106.

Fingers 98 are held in the radial, outward position by one or more release dogs 108. Release dog 108 are, in turn, held in a radially outward position by a slidable piston 110 positioned for axial motion along flow path 58 within lock sub 88. Release dogs 108 typically are mounted for radial movement in corresponding openings 111 formed through lock sub 88.

In this particular embodiment, slidable piston 110 forms a part of release mechanism 60 which may be hydraulically actuated. Axial movement of piston 110 to a desired location permits the radially inward movement of release dogs 108 and fingers 98 to release running tool 18 from liner 10. Specifically, when hydraulic fluid is pressurized in flow path 58 above slidable piston 110, the hydraulic fluid moves through an axial opening 112 extending longitudinally through slidable piston 110. The fluid moves a ball 114 against a ball seat 116. Continued application of pressure forces slidable piston 110 towards a ball seat catcher mechanism 118 until release dogs 108 are allowed to move radially inward into an appropriately formed receptacle or receptacles 120 recessed into slidable piston 110. In the illustrated embodiment, the hydraulic pressure must be sufficiently high to shear one or more shear pins 122, thereby permitting the slidable motion of piston 110. Appropriate pipe plugs 124 may be deployed in lock sub 88 at radially outward positions from shear screws 122, as illustrated.

Ball seat catcher 118 may be attached to lower sub 92 via, for example, an internal threaded region 126. Additionally, ball seat catcher 118 may have one or more openings 128 to permit the flow of material through running tool 18 during cementation of liner 10. An appropriate stinger or stinger assembly 130 also may be coupled to lower sub 92 by, for example, a threaded region 132.

Referring generally to FIG. 3A, an exemplary liner 10 is illustrated. Liner 10 comprises a liner casing 134 having a generally hollow interior 136. Liner 10 further comprises an engagement feature 138 by which connection assembly 20 and running tool 18 may be engaged with liner 10. An exemplary engagement feature 138 comprises a flush bore running collar 140 that has an appropriately sized groove 142 for receiving fingers 98 when they are disposed in the radially outward position to lock running tool to liner 10. Groove 142 permits use of the entire inside diameter (flush bore) of liner 10.

Additionally, the exemplary liner 10 comprises a packoff bushing 144 sized to receive lower sub 92 of running tool 18. Packoff bushing 144 has a plurality of fingers 146 spaced to receive lead fingers 96 of lower sub 92. When engaged, lead fingers 96 and packoff bushing fingers 146 allow application of an axial force and/or a torque to liner 10. Liner 10 also may include certain other features, such as a float collar 148 having a float valve 150 as well as a leading end float shoe 152 having a float valve 154.

Figure 3B:
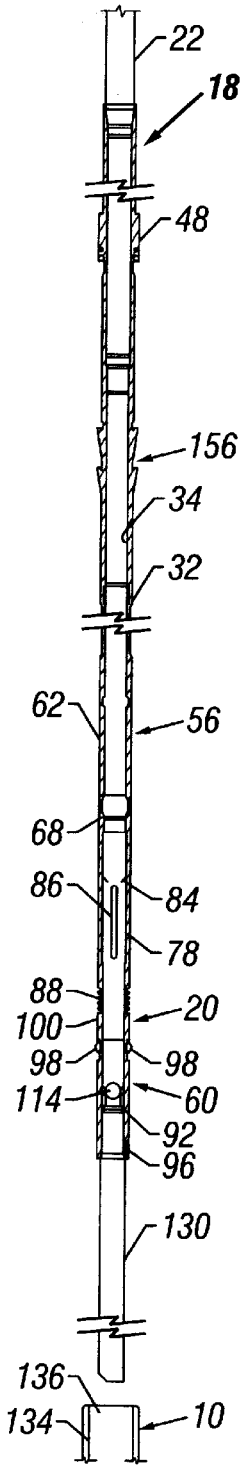
FIG. 3B illustrates the flush bore running tool positioned for insertion into the liner.
Figure 3C:
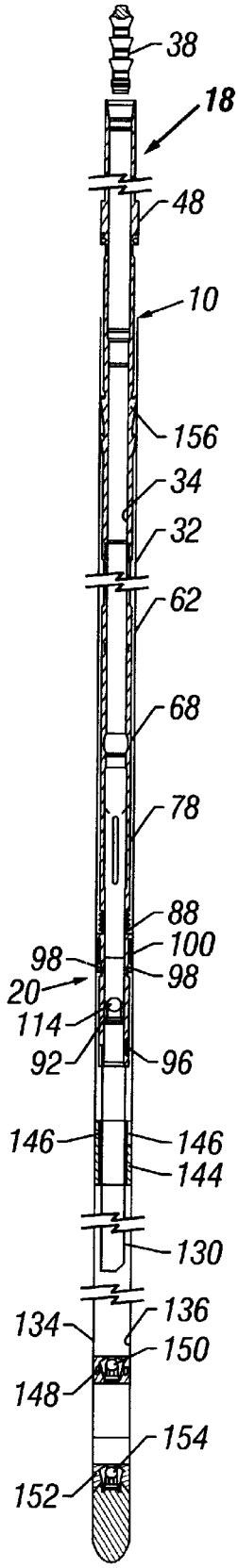
FIG. 3C illustrates the flush bore running tool coupled to the liner illustrated in FIG. 3A.

As illustrated in FIG. 3B, running tool 18 is sized for insertion into hollow interior 136 of liner 10. Running tool 18 is inserted until fingers 98 engage groove 142 of flush bore collar 140 and lead fingers 96 engage fingers 146 of packoff bushing 144 (see FIG. 3C). When inserted, closure member 48 is positioned to reduce the debris that could otherwise fall into the upper open end of liner 10. Additionally, a swab cup assembly 156 is positioned to slide into hollow interior 136.

Thus, running tool 18 may be inserted into liner 10 and locked in place via connection assembly 20. The liner 10 may then be moved into a desired wellbore, such as lateral wellbore 14 (see FIG. 1). Once the liner is at the desired downhole location, it may be cemented in place by pouring an appropriate amount of cementation material into deployment tubing 22. Dart assembly 38 is placed over the cementation material and pumped downward via an appropriate fluid. This moves the cementation material through flow path 58 of running tool 18 until dart assembly 38 is captured at dart by-pass sub 78. The cementation material is deposited through stinger 130 to cement liner 10 at the desired wellbore location. Either prior to or subsequent to cementation, running tool 18 may be released from liner 10 via release mechanism 60. Subsequent to cementation of liner 10, the running tool 18 is withdrawn from liner 10 and removed from the wellbore.

It should be noted that any components utilized in hollow interior 136 of liner 10, e.g. packoff bushing 144, float collar 148 and float shoe 152 are formed from materials readily drillable by a standard rock bit. Thus, liner 10 retains its flush bore characteristics while being locatable within the wellbore with a pulling force (via running tool 18) rather than a pushing force. The unique configuration of running tool 18 and liner 10 permit tensile deployment of liner 10 without requiring extra trips downhole to mill threads or other inwardly extending features that would otherwise prevent use of the full internal diameter of liner casing 134.

It will be understood that the foregoing description is of preferred exemplary embodiments of this invention, and that the invention is not limited to the specific forms shown. For example, a variety of liner casings may be utilized; the components of the running tool structural housing, connection assembly and release mechanism may vary; and the system may be utilized in a variety of downhole environments. These and other modifications may be made in the design and arrangement of the elements without departing from the scope of the invention as expressed in the appended claims.

What is claimed is:

1. A system for lining a wellbore, comprising:

a liner sized to fit within a wellbore; and a running tool coupled to the liner by a flush bore collar disposed generally at a lead end of the liner to place the liner in tension when deployed into the wellbore.

2. The system as recited in claim 1, further comprising a hydraulic release to permit selective disconnection of the running tool from the liner.

3. The system as recited in claim 1, wherein the running tool comprises a collet positioned to engage the flush bore collar.

4. The system as recited in claim 1, further comprising a packoff bushing positioned in the liner to engage the running tool when the liner is run into the wellbore.

5. The system as recited in claim 2, further comprising a stinger coupled to a lead end of the running tool.

6. The system as recited in claim 1, wherein the running tool comprises a dart by-pass sub.

7. The system as recited in claim 3, wherein the collet comprises a plurality of fingers that may be held in a radially outward position to engage the flush bore collar.

8. The system as recited in claim 7, wherein the running tool further comprises a slidable lock piston to hold the plurality of fingers in the radially outward position via at least one release dog.

9. The system as recited in claim 8, wherein the slidable lock piston comprises at least one receptacle positioned to receive the at least one release dog upon selected movement of the slidable lock piston.

10. The system as recited in claim 9, wherein the running tool further comprises a ball valve that, upon closure, permits pressure to be used for moving the slidable lock piston.

11. The system as recited in claim 1, further comprising a closure member disposed above the liner to limit the amount of debris that enters the liner during running of the tool.

12. A method for lining a wellbore, comprising:

connecting a running tool to a liner via a connection assembly disposed proximate a lead end of the liner;

pulling the liner into the wellbore via the running tool; and maintaining the interior of the liner free from obstructions that would prevent penetration of a rock bit.

13. The method as recited in claim 12, wherein pulling comprises pulling the liner into a lateral wellbore.

14. The method as recited in claim 13, wherein connecting the running tool to the liner via the connection assembly comprises engaging the running tool to a flush bore collar.

15. The method as recited in claim 14, wherein engaging comprises coupling the running tool to the flush bore collar with a collet.

16. The method as recited in claim 15, further comprising releasing the running tool from the liner.

17. The method as recited in claim 16, wherein releasing comprises utilizing a hydraulic release.

18. The method as recited in claim 13, further comprising cementing the liner by moving a material through the running tool.

19. The method as recited in claim 18, further comprising locating a dart assembly at an upstream end of the material during movement of the material through the running tool.

20. A running tool configured for coupling to a liner, comprising:

an elongate structure substantially disposed within the liner;

a plurality of fingers that may be placed in a radially outward position relative to the elongate structure to engage the liner; and a release mechanism positioned in cooperation with the plurality of fingers to selectively release the fingers from the liner.

21. The running tool as recited in claim 20, wherein the plurality of fingers are formed on a collet.

22. The running tool as recited in claim 20, further comprising at least one release dog, wherein the plurality of fingers are held in the radially outward position by the at least one release dog.

23. The running tool as recited in claim 22, further comprising a slidable lock piston positioned to hold the at least one release dog against the plurality of fingers when in the radially outward position.

24. The running tool as recited in claim 23, wherein the slidable lock piston comprises a receptacle to receive the at least one release dog when the slidable lock piston is moved to a release position.

25. The running tool as recited in claim 20, wherein the release mechanism comprises a hydraulic release mechanism.

26. The running tool as recited in claim 24, wherein the release mechanism comprises a ball valve that may be closed selectively to permit movement of the slidable lock piston via hydraulic pressure.

27. The running tool as recited in claim 20, further comprising a stinger coupled to the elongate structure.

28. The running tool as recited in claim 20, wherein the elongate structure comprises a dart by-pass sub.

29. The running tool as recited in claim 28, further comprising a dart assembly.

30. The running tool as recited in claim 20, wherein the elongate structure comprises an internal flow path.

* * * * *